US007182316B2

(12) United States Patent
Sykes

(10) Patent No.: US 7,182,316 B2
(45) Date of Patent: Feb. 27, 2007

(54) ADJUSTABLE SUPPORT BRACKET

(76) Inventor: Richard D. Sykes, 4122 Bennett Memorial Rd., Ste. 101, Durham, NC (US) 27705

( * ) Notice: Subject to any disclaimer, the term of this patent is extended or adjusted under 35 U.S.C. 154(b) by 165 days.

(21) Appl. No.: 11/051,391

(22) Filed: Feb. 3, 2005

(65) Prior Publication Data

US 2005/0172427 A1 Aug. 11, 2005

Related U.S. Application Data

(60) Provisional application No. 60/542,446, filed on Feb. 5, 2004.

(51) Int. Cl.
*B66F 3/08* (2006.01)

(52) U.S. Cl. ..... 254/85; 254/93 R

(58) Field of Classification Search ..... 254/85, 254/122–126, 100–103, 93 R, 89 H
See application file for complete search history.

(56) References Cited

U.S. PATENT DOCUMENTS 2,904,308 A * 9/1959 Vergara ..... 254/8 R
5,172,442 A * 12/1992 Bartley et al. ..... 5/611
5,690,315 A * 11/1997 Thomas ..... 254/93 R
6,305,668 B1 * 10/2001 Edens ..... 254/93 R
2005/0172427 A1 * 8/2005 Sykes ..... 14/75

* cited by examiner

*Primary Examiner*—Lee D Wilson
(74) *Attorney, Agent, or Firm*—Michael E. Mauney

(57) ABSTRACT

An adjustable support bracket to be used in combination with a support pier or post to support a structure subject to weights or loads. A support pier is placed in proximity to a surface requiring support. At the end of the support pier, in proximity to the surface requiring support, a generally rigid flat surface is placed. On that flat surface are a plurality of support bolts generally perpendicular to the flat surface. The bolts are threaded and are provided with locking nuts. A matching second flat surface is placed above the first flat surface and between the first flat surface and the structure requiring support. A plurality of sleeves are on the second flat surface. The sleeves are sized and shaped for receipt of the support bolts on the first flat surface. The sleeves are slipped over the bolts on the first flat surface, leaving a space between the first and second flat surfaces. A jack or other lifting device is placed in this space and is used to push the second flat surface into contact with the structure requiring support. Once an appropriate level of support is achieved, locking nuts on the threaded support bolts are rotated into place against the sleeves on the second flat surface to provide support to the second flat surface for any weight placed on the second flat surface because of its proximity to the structure requiring support. The jack may then be removed and the support pier with the support bracket now bears the load generated by the structure requiring support.

17 Claims, 6 Drawing Sheets

550
560
515
510
515
560
510
515
560
510
515
500
450
455
450
455
450
455

ADJUSTABLE SUPPORT BRACKET

RELATED APPLICATION

This invention was described in my provisional application 60/542,446 filed 5 Feb. 2004.

TECHNICAL FIELD

This invention relates generally to an adjustable support bracket which can be used in combination with a support pier or post to support a lateral girder which is subject to weights or loads.

BACKGROUND OF THE INVENTION

In the construction industry, lateral support surfaces or floors are often elevated above the substrate on which they must ultimately be supported. The substrate is ordinarily ground, soil, fill dirt, or the like. Occasionally, the floor can be supported directly on a leveled substrate or ground by a concrete pad. Under these circumstances there may not be a foundation, nor is there any need for a support pier for the horizontal girder or floor. More commonly, the floors are raised above ground level or the substrate support level. A durable rigid material, such as plywood or flooring, will be supported at intervals by a lateral girder. These can be floor joists, 2×4's, 4×6's, metal girders, wooden girders and the like. Periodically, these lateral girders must receive support not only at the ends but also at points along the length of the lateral girders. For example, in a crawl space under a house, the foundation will ordinarily be concrete blocks or concrete piers. Lateral girders will run from one support pier to another support pier. The floor surface may be mounted on these lateral girders, either directly or there may be intervening floor joists. However, ultimately the entire weight supported by the structure must be supported by the concrete piers, wood posts, or whatever else is vertically sunk into the ground or substrate.

On occasion, the lateral girder may begin to sag. This can arise from a variety of causes. First, through poor design or miscalculation of the loads these lateral girders are required to carry, they may simply not be strong enough to support the weight which is placed on them in the area between the points of vertical support piers or posts and the point the load is applied. Secondly, there may be settling of the vertical support piers or posts. This can happen from a variety of causes. The soil can be soft and, as weight is applied, the vertical post can sink further into the soil. The concrete footers which may support the piers may not have been large enough to begin with. The soil can shrink over time so that the vertical piers, instead of supporting the lateral girder, will settle and allow the supported girder to sag.

When there is sagging of the lateral girder, it may be possible to use a jack, ordinarily hydraulic, to raise the lateral girder beam and to place shims between the vertical piers and lateral girder. However, this is simply a temporary fix since there may be more settling over time. Consequently, there is a need for a permanent way of providing support from the ground to a lateral girder where, for whatever reason, the girder is sagging.

SUMMARY OF THE INVENTION

The current adjustable bracket invention is used in conjunction with a vertically mounted support pipe. The pipe can be mounted into the substrate a variety of ways, but is done so that it can bear the appropriate load without sinking any further into the substrate. The adjustable bracket is fixed to the top of the support pipe. The support pipe terminates directly below the lateral girder which requires support. The adjustable support bracket is affixed to the top of the pipe but below the lateral load-bearing girder which requires support. A removable hydraulic jack is used in conjunction with the adjustable bracket. The jack is placed between the upper and lower plate of the bracket and a hydraulic load is applied to the jack to raise the upper plate of the bracket. The lower plate of the bracket supports the jack and the lower plate is in turn supported by the vertical pipe. As the jack raises the upper plate of the bracket, it comes into contact with the lateral girder. More pressure is applied to the jack, which will continue to raise the upper plate of the bracket. This is done gradually. The sag of the lateral girder is monitored. When the girder is level and no longer sagging, the upper plate can be locked into place using nuts on threaded locking bolts which are mounted on the lower support plate of the adjustable bracket. Once the nuts are tightened into place and the bracket is supported by the nuts on the locking bolts, the hydraulic pressure supporting the hydraulic jack may be released. The girder will not sag because it is now supported by the nuts on the locking bolts supported on the lower plate of the hydraulic bracket. The jack may be removed and a permanent repair is in place.

DETAILED DESCRIPTION OF THE DRAWINGS

Figure 1:
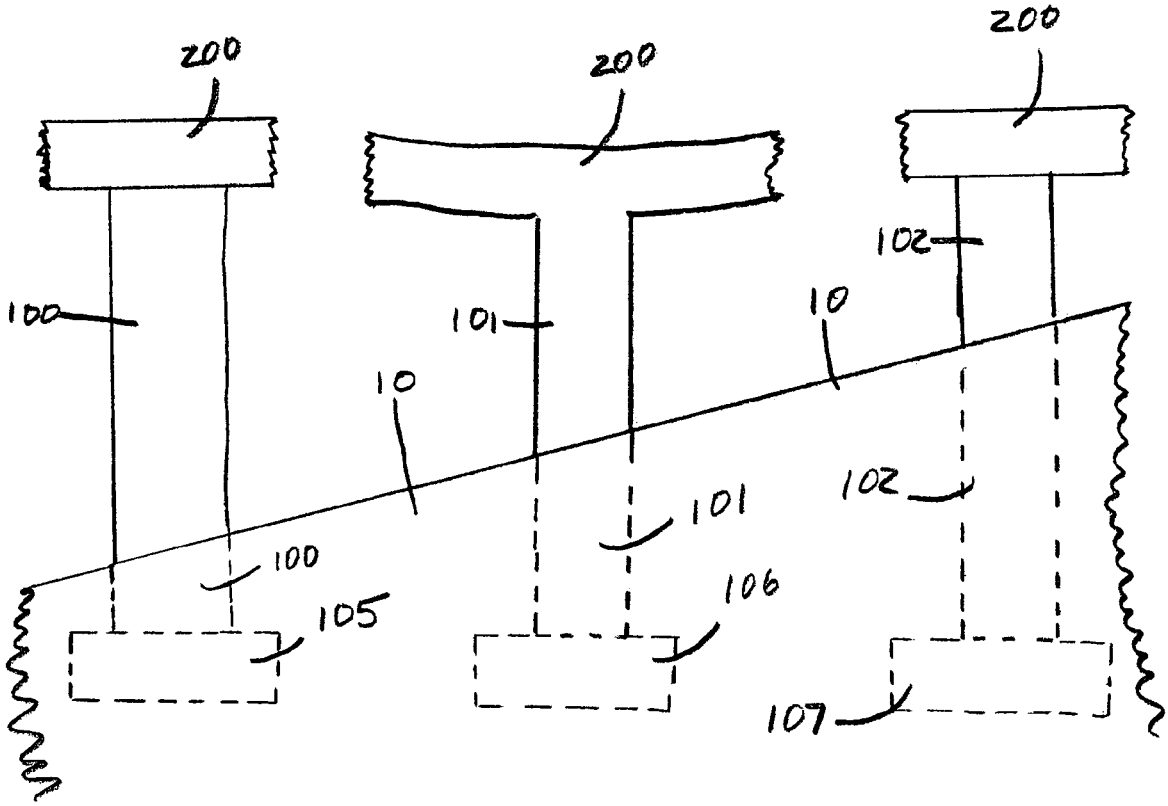
FIG. 1 shows a sagging lateral support girder.

FIG. 1 shows in cut-a-way and in exaggerated fashion the problem to be solved by the adjustable support bracket (400) which will be described herein. A lateral support girder (200) is supported at one end by a support pier (100) and at the other end by a support pier (102). The piers are sunk into a substrate, here, the ground (10), to the point they are supported by a footer, respectively (105) and (107). Because the lateral support girder (200) has a considerable length and because it will receive loads in the middle, as well as at the ends that are supported by the piers (100) and (102), a central support pier (101) is shown also buried within the ground (10) and supported by a footer (106). However, here, the central pier (101) has sunk. This means that the upper end of the pier (101) which was initially at the same level as the upper end of the piers (100) and (102) has now sunk below that level meaning that no support is provided to the girder (200) at the point of pier (101) unless the girder (200) sags to the top of the support pier (101). Here, the girder (200) is shown sagging slightly. It will continue to bend upwardly until it is supported by the piers (100) and (102). Consequently, the support girder (200) is not in a straight horizontal line and is not providing a straight horizontal support for any flooring that is mounted on the girder (200).

This sagging in the middle of the girder (200) creates a variety of problems for the building owner.

Figure 2:
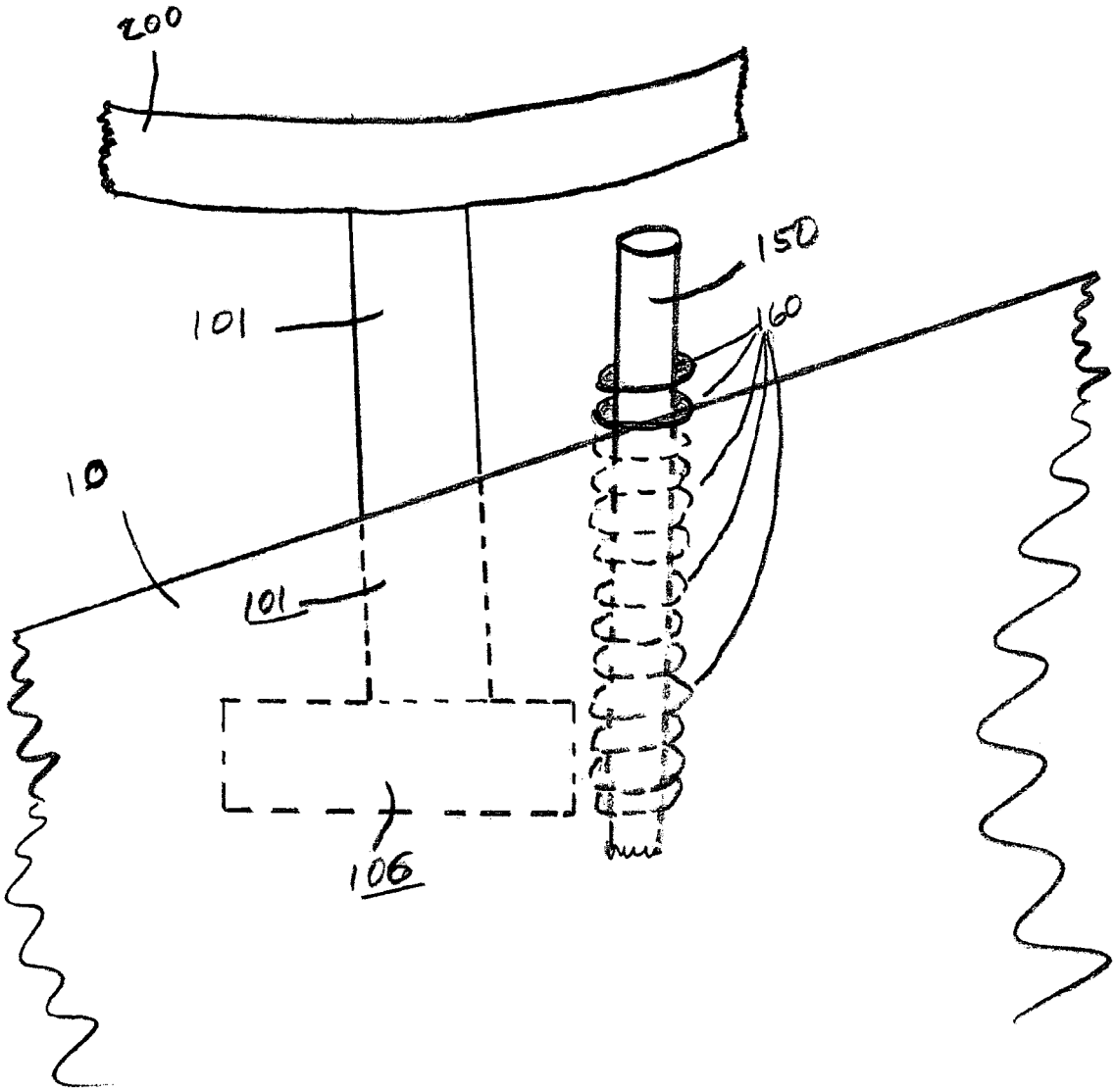
FIG. 2 shows the beginning of a repair using an auxiliary support pipe.

FIG. 2 shows a detail from FIG. 1 in which the lateral support girder (200) is shown supported by the sunken support pier (101) and the footer (106). In proximity to the support pier (101), is an auxiliary support pipe (150). This can be mounted into the ground (10) in a variety of fashions. For example, it can be driven into the ground by a pile driver. However, frequently the need for such an auxiliary support pipe (150) is in an existing structure which limits the options for sinking the auxiliary support pipe (150) into the ground (10). Here it is shown with a helical screw-like flange (160). This allows a machine to turn the auxiliary support pipe (150) into the ground. The helical flanges (160) will turn in the ground (10), much like a wood screw will set itself into wood, by digging gradually into the ground (10) under the torque and pressure provided by a machine designed for the purpose of setting such a support pipe (150) into the ground. The auxiliary support pipe (150) can be sunk into the ground (10) in this fashion until it is deemed to be securely set into the ground (10). This could be indicated by an inability to drive the support pipe (150) any further into the ground (10) by use of the flanges (160). It could also be indicated by the amount of torque necessary to turn the support pipe (150). At some point, by adding further sections of pipes (150) as they are sunk into the ground (10), a level of resistance will be met sufficient to indicate that the pipe (150) now is securely sunk into the ground (10) so as to support the expected load. At this point, the end of the support pipe (150) is trimmed an appropriate distance from the lateral girder (200).

Figure 3:
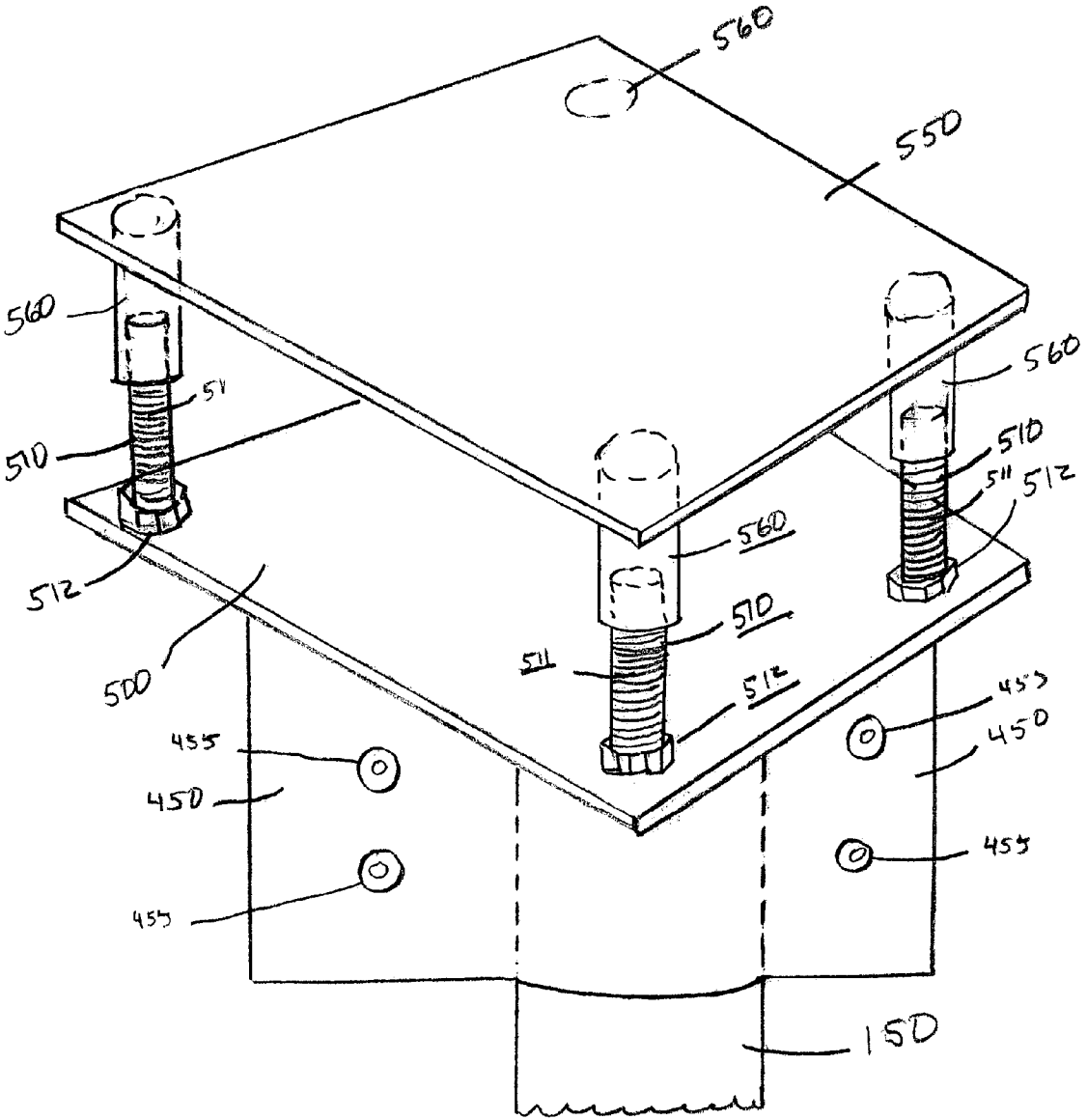
FIG. 3 shows the adjustable support bracket in an exploded view.

FIG. 3 shows an exploded view of the adjustable support bracket (400). There is a lower support plate (500) which will be mounted on the auxiliary support pipe (150) by the mounting bracket (450). The mounting bracket (450) is shown in more detail in FIG. 3A. A plurality of threaded support bolts (510) are mounted on the lower support plate (500). In the preferred embodiment, there are four support bolts (510). In FIG. 3, the support bolts (510) are shown with the fourth support bolt (510) hidden from view by the upper support plate (550). These bolts are threaded (511) and a locking nut (512) is threaded onto each of the support bolts (510). The upper support plate (550) is shown positioned above the lower support plate (500). Matching each of the support bolts (510) is a sleeve (560) which will slide over the support bolts (510) to ultimately rest against the locking nuts (512). The support bolts (510) and matching sleeve (560) will ordinarily be several inches in length. This will initially allow clearance between the upper support plate (550) and the lateral girder (200) which requires support. Enough space will be left between the upper support plate (550) and the bottom of the lateral girder (200) to allow the adjustable support bracket (400) to be affixed to the top of the support pipe (150) but below the lateral girder (200) with some clearance between the lateral girder (200) and the upper support plate (550).

Figure 3A:
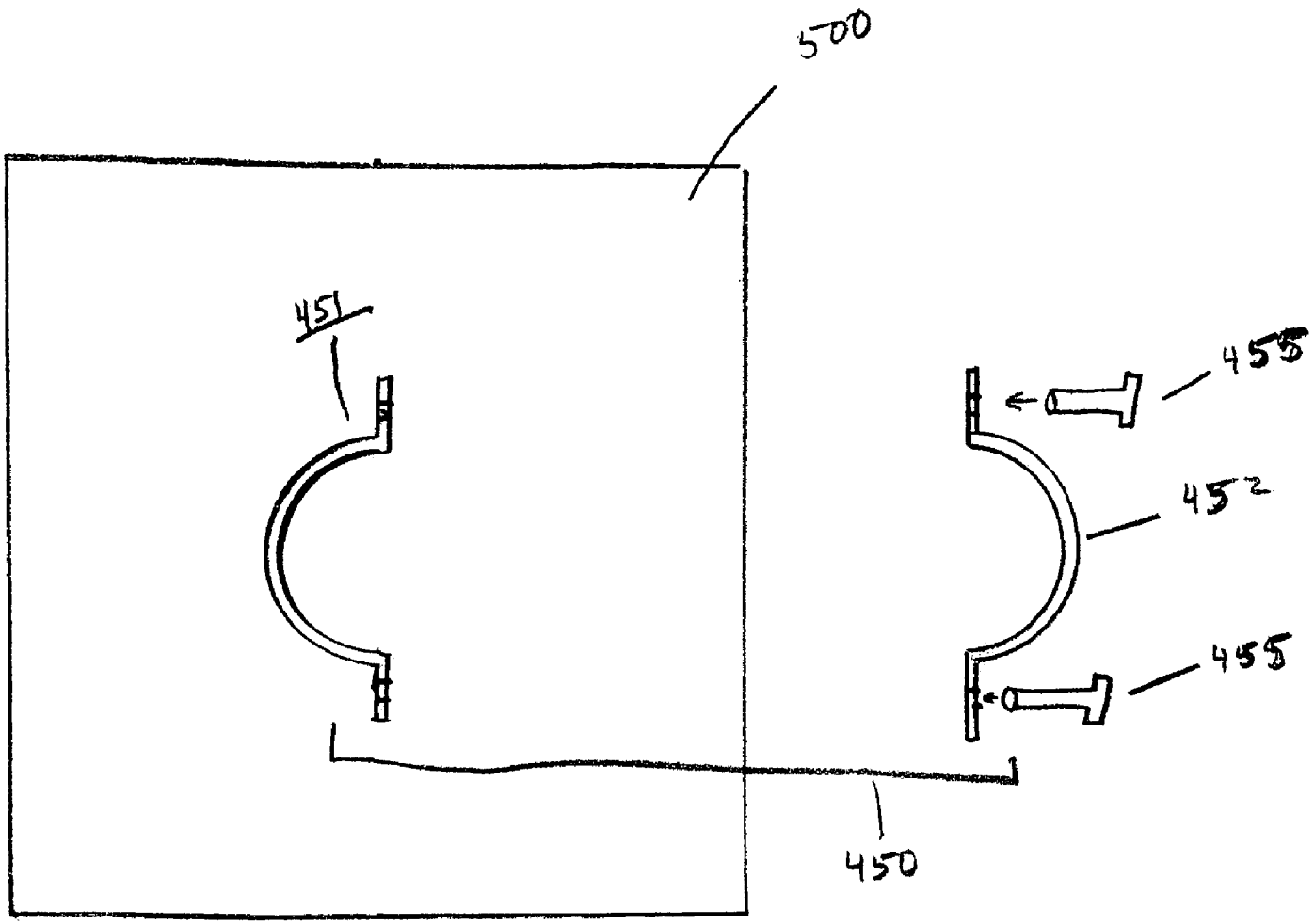
FIG. 3A shows the mounting of the adjustable support bracket.

FIG. 3A shows the mounting bracket (450) as seen from below. The mounting bracket (450) is in two pieces. A fixed U-shaped piece (451) is ordinarily permanently affixed to the bottom of the lower support plate (500). At each end of the U-shape piece (451) is a flange. There is a moveable matching U-shaped piece (452). The support pier (150) (not shown in FIG. 3A) will be positioned approximately half within the U-shaped declivity on the piece (451), with the bottom of the lower support plate (500) resting against the top of the support pier (150). The matching U-shaped piece (452) will then be placed around the remaining portion of the support pier (150) and a plurality of bolts (455) will be placed through appropriate bolt holes on the flange (451) or the pieces (452) and secured in place by a locking nut (not shown). The bolts (455) are held in place, thus securing the lower support plate (450) in place against the support pier (150).

Figure 4:
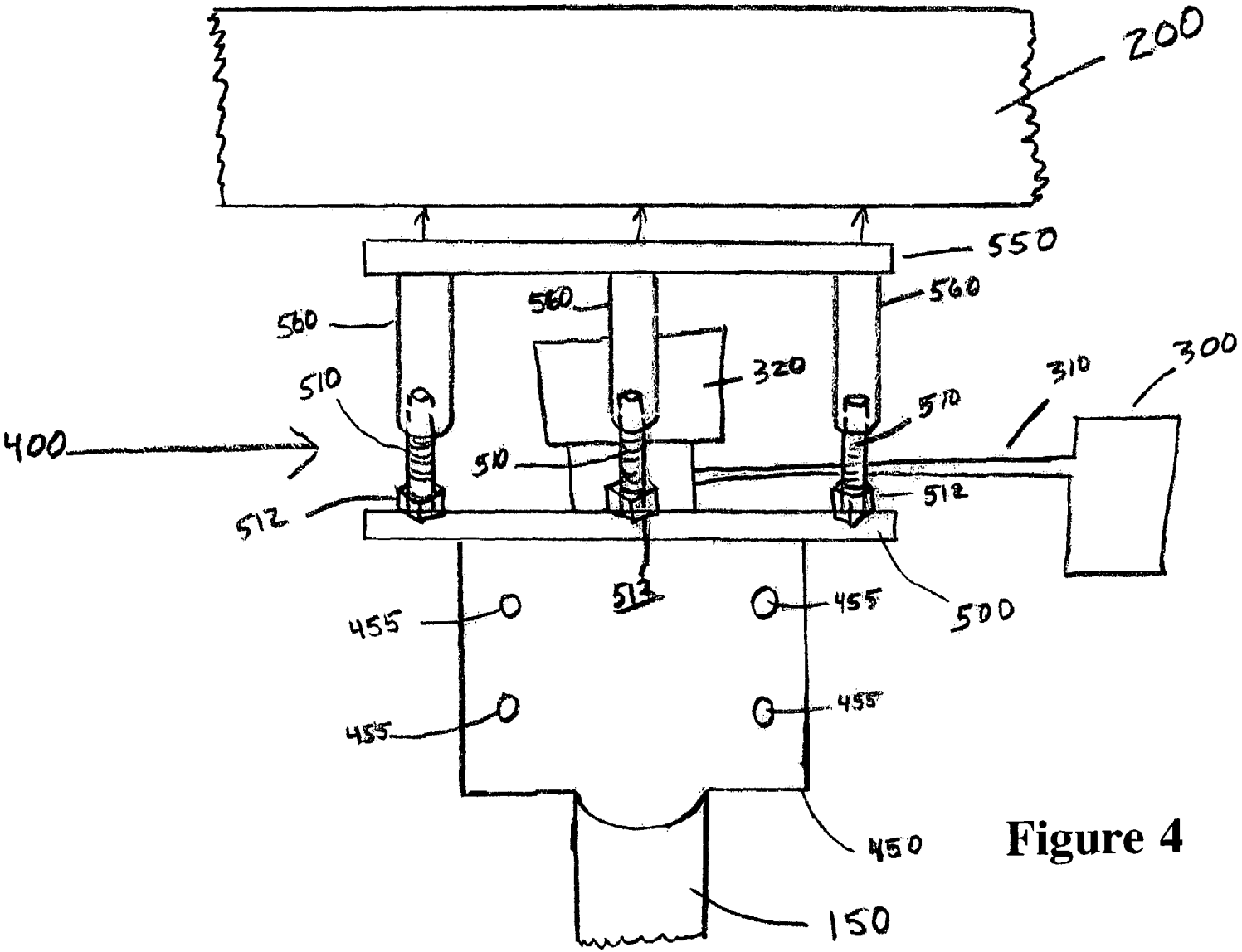
FIG. 4 shows the adjustable support bracket on a support pipe below a lateral girder.

FIG. 4 shows the adjustable support bracket (400) mounted on a support pipe (150) below a lateral girder (200) in place and ready for use. The upper plate (550) is positioned just below the girder (200). The sleeves (560) are down on the support locking bolts (510) with the locking nuts (512) below the sleeves (560). A hydraulic pump (300) is connected by a hydraulic line (310) to a hydraulic jack (320). The hydraulic pump (300) will be activated, forcing hydraulic fluid through the hydraulic line (310) to the hydraulic jack (320) and raising the hydraulic jack (320) in the direction shown by the arrow. The hydraulic jack (320) will come into contact with the lower surface of the upper support plate (560) raising it until it comes into contact with the lateral girder (200). More pressure may be applied until the lateral girder (200) has been raised from its point of sag to the appropriate level position and in line with other vertical support piers, not shown in this drawing but seen in FIG. 1. At that point, while hydraulic pressure is still being applied to the hydraulic jack (320), the locking nuts (512) may be threaded up the support locking bolts (510) until they come into contact with the bottom of the sleeves (560). The locking nuts (512) can then be locked into place, thus supporting the sleeves (560) against any downwardly directed force from the lateral girder (200). The hydraulic pressure on the hydraulic jack (320) may be reversed causing the hydraulic jack (320) to settle into a relaxed position and the jack is now ready to be removed.

Figure 5:
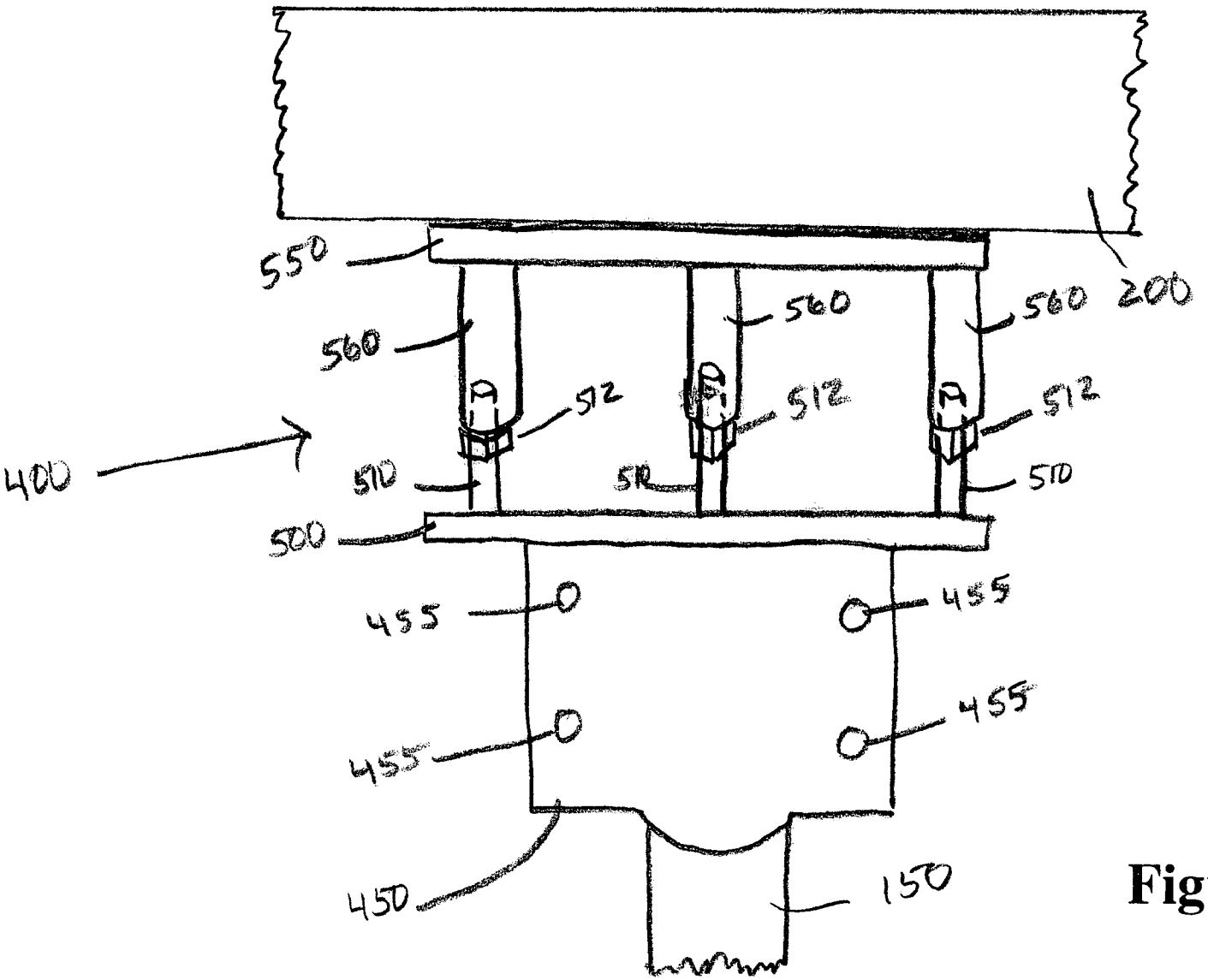
FIG. 5 shows the adjustable support bracket in a fully mounted position.

FIG. 5 shows the adjustable support bracket (500) mounted on the support pipe (150) in place and supporting the girder (200). The upper support plate (500) is in place against the girder (200). The supporting sleeves (560) which are on the underside of the upper support plate (550) are now supported on the support locking bolt (510) by the locking nuts (512) which have been screwed on the threads on the support bolts (510) to where they are flush against the sleeves (560), The hydraulic jack (320), seen in FIG. 4, has completed its work and has been removed. The weight which was causing the girder to sag is now supported by the vertical pipe (150) by using the adjustable support bracket (400). The locking bolts (510), the sleeves (560), and the locking nuts (512) are of sufficient size and strength to be able to support the expected load presented by the weight on the girder (200). In this fashion, a vertical pipe (150) may be placed into the support substrate using existing technology, then using the adjustable support bracket (400) a permanent repair can be quickly and effectively completed.

It will be appreciated by one of skill in the art that the foregoing explanation is by way of illustration and not of limitation. The limitations are found only in the claims which follow. Variations in size, materials and design may be made by one of ordinary skill in the art without departing from the essential teachings of this invention.

I claim:

1. An adjustable support bracket for use in combination with a support pier to support a structure subject to loads comprising:

(a) a first generally flat rigid surface of sufficient thickness and strength to support a definite load;

(b) on said first flat surface a plurality of support bolts generally perpendicular to said first flat surface, said perpendicular support bolts threaded for use with locking nuts;

(c) a second flat rigid surface of a general size and structure similar to said first flat surface;

(d) on said second flat surface, a plurality of sleeves sized and shaped for receipt therein of said perpendicular support bolts on said first flat surface;

(e) locking nuts on said threaded perpendicular support bolts;

whereby said adjustable support bracket may be used to support a structure subject to loads when said adjustable support bracket is placed on a support pier, a lifting device is placed between said first and second flat surface and used to raise said second flat surface to come into contact with a structure subject to load, said locking nuts on said support bolts are threaded snug against said sleeves, then said lifting device is removed from said lifting devices position between said first and second flat surfaces and said adjustable support bracket and a support pier now support said structure subject to loads.

2. An adjustable support bracket for use in combination with a support pier to support a structure subject to loads of claim 1 further comprising means for mounting a first generally flat rigid surface to said support pier.

3. An adjustable support bracket for use in combination with a support pier to support a structure subject to loads of claim 2 wherein said means for mounting further comprises a first mounting bracket attached to said first generally flat rigid surface with a declivity therein for placement of at least a portion of said support pier, and a second mounting bracket with a declivity therein, said second mounting bracket is of a general shape, size, and structure matching said first mounting bracket and means for attaching said first mounting bracket to said second mounting bracket.

4. An adjustable support bracket for use in combination with a support pier to support a structure subject to loads of claim 3 wherein there are at least three generally perpendicular support bolts.

5. An adjustable support bracket for use in combination with a support pier to support a structure subject to loads of claim 4 wherein said first flat surface and said second flat surface, said sleeves on said second flat surface and said support bolts on said first flat surface are of a definite size for receipt between said first flat surface and said second flat surface, a hydraulic jack.

6. An adjustable support bracket for use in combination with a support pier to support a structure subject to loads of claim 5 further comprising means for mounting said first flat surface to a support pier.

7. An adjustable support bracket for use in combination with a support pier to support a structure subject to loads of claim 6 wherein said first flat surface is mounted by said means for mounting to a vertical support pier and said second flat surface is used to support a horizontal girder supporting supporting a horizontal surface in a building.

8. An adjustable support bracket for use in combination with a support pier to support a structure subject to loads of claim 7 wherein a vertical support pier is a support pier mounted in a supporting substrate by means of helical flanges mounted along an outer surface of said support pier whereby said support pier is screwed into the ground using said helical flanges until there is a definite indication said support pier is securely and permanently mounted into said substrate.

9. An apparatus for leveling and supporting a sagging horizontal support girder comprising:

(a) an auxiliary support pier;

(b) means for sinking said auxiliary support pier into a support substrate;

(c) a first flat surface mountable on an exposed end of said auxiliary support pier;

(d) means for mounting said first flat surface on said support pier;

(e) on said first flat surface a plurality of vertical support bolts threaded for use with a locking nut;

(f) a second flat surface including sleeves mounted on said second flat surface for receipt of said vertical support bolts for slidable movement of said second flat surface on said support bolts;

(g) means for raising said second flat surface until said second flat surface levels and supports a sagging horizontal girder;

(h) at least one locking bolt for each of said plurality of vertical support bolts, said locking nut rotated into place on each of said threads on said support bolts to permanently fix said second support plate into place against said sagging girder;

whereby said auxiliary support pier is sunk into the supporting substrate at an appropriate height in proximity to said horizontal girder, said first and second flat surfaces are used in conjunction with means to lift said second flat surface into place against said sagging girder and said locking nuts are used to permanently lock said second flat surface into place.

10. An apparatus for leveling and supporting a sagging horizontal support girder of claim 9 wherein said means for mounting further comprises a first mounting bracket attached to said first generally flat rigid surface, said first mounting bracket with a declivity therein for placement of at least a portion of said support pier, a second mounting bracket, with a declivity therein, of a general shape, size, and structure matching said first mounting bracket and means for attaching said first bracket to said second bracket.

11. An apparatus for leveling and supporting a sagging horizontal support girder of claim 10 wherein said plurality of vertical support bolts includes at least three vertical support bolts.

12. An apparatus for leveling and supporting a sagging horizontal support girder of claim 11 wherein said means for raising said second flat surface is a jack sized for insertion between said first flat surface and said second flat surface.

13. A method for leveling and supporting a sagging horizontal support girder, the method including steps of comprising:

(a) sinking an auxiliary support pier into a support substrate, said auxiliary support pier in proximity to a sagging horizontal support girder;

(b) mounting a first flat surface on an exposed end of said support pier;

(c) placing a second flat surface above said first flat surface;

(d) providing on said first flat surface a plurality of vertical support bolts;

(e) providing on said second flat surface a plurality of sleeves, said sleeves sized for receipt therein of said vertical support bolts;

(f) providing locking nuts threaded onto said vertical support bolts;

(g) raising said second flat surface until said second flat surface provides support to said sagging horizontal support girder by using a means for raising said second flat surface;

(h) threading said locking nuts on said thread on said vertical support bolts until said locking nuts are snug against said sleeves on said second flat surface.

14. A method for leveling and supporting a sagging horizontal support girder of claim 13 wherein said step of mounting a first flat surface further comprises providing a first mounting bracket attached to said first flat surface, said first mounting bracket provided with a declivity therein matching at least a portion of said support pier and providing a second mounting bracket, said second mounting bracket is of a general shape, size, and structure matching said first mounting bracket and further providing means for attaching said first mounting bracket to said second mounting bracket.

15. A method for leveling and supporting a sagging horizontal support girder of claim 14 further comprising providing at least three vertical support bolts.

16. A method for leveling and supporting a sagging horizontal support girder of claim 15 further comprising providing on said auxiliary support pier helical flanges on an outside surface of said horizontal support pier whereby said horizontal support pier may be sunk into a support substrate by turning said support pier and said helical flanges so that said support pier is sunk into said support substrate using said helical flanges to screw said auxiliary support pier into the support substrate.

17. A method for leveling and supporting a sagging horizontal support girder of claim 16 wherein said step of raising said second flat surface includes a step of providing a lifting device between said first flat surface and said second flat surface so that said second flat surface is lifted by said lifting device.

* * * * *